US005975154A

United States Patent [19]

Bennett

[11] Patent Number: 5,975,154

[45] **Date of Patent: *Nov. 2, 1999**

[54] FUEL OVERFLOW PREVENTION SYSTEM WITH FEEDBACK

[75] Inventor: Willard M. Bennett, Bath, Me.

[73] Assignee: Benric Technologies, South Portland, Me.

[ * ] Notice: This patent is subject to a terminal disclaimer.

[21] Appl. No.: 09/181,475

[22] Filed: Oct. 28, 1998

Related U.S. Application Data

[63] Continuation-in-part of application No. 08/715,007, Sep. 17, 1996, Pat. No. 5,829,491.

[51] Int. Cl.[6] ..... B67D 5/32

[52] U.S. Cl. ..... 141/59; 141/95; 141/198; 141/326; 141/382; 116/110; 114/343

[58] Field of Search ..... 141/59, 95, 198, 141/325, 326, 382, 392; 116/109, 110; 114/343

[56] References Cited

U.S. PATENT DOCUMENTS

| | | | |
|---|---|---|---|
| 2,208,989 | 7/1940 | Lewis | 141/382 |
| 2,249,180 | 7/1941 | Scully et al. | 116/110 |
| 2,495,905 | 1/1950 | Pogue | 141/59 |
| 2,703,194 | 3/1955 | White | 141/325 |
| 3,103,958 | 9/1963 | Rath | 141/96 |
| 3,136,295 | 6/1964 | Gramo | 116/118 |
| 3,674,061 | 7/1972 | Calisher et al. | 141/198 |
| 3,967,660 | 7/1976 | Russell | 141/95 |
| 5,023,608 | 6/1991 | Delisle et al. | 340/984 |
| 5,181,022 | 1/1993 | Schupp | 340/616 |
| 5,449,029 | 9/1995 | Harris | 141/198 |
| 5,462,100 | 10/1995 | Covert et al. | 141/59 |
| 5,515,891 | 5/1996 | Langlois | 141/307 |
| 5,673,736 | 10/1997 | Farkas | 141/198 |
| 5,785,100 | 7/1998 | Showalter et al. | 141/198 |

FOREIGN PATENT DOCUMENTS

0719728A1 7/1996 European Pat. Off. .

*Primary Examiner*—J. Casimer Jacyna
*Attorney, Agent, or Firm*—Pierce Atwood; Chris A. Caseiro

[57] ABSTRACT

A fuel overflow prevention system for substantially eliminating fuel spillage both due to over-filling during fueling and due to fuel expansion in fuel tanks. The device includes a fuel discharge preventor and a nozzle adapter that work together during re-fueling to allow displacement by fuel of gases within the fuel tank until such time that the fuel reaches a predetermined level in the tank. The system also includes a feedback coupling to permit the transfer of excess fuel from the preventor back to the fuel inlet, particularly when an automatic shutoff nozzle is employed. The system further includes an extension tube to allow remote location of a housing containing the discharge prevention valving of the invention. The discharge prevention housing only permits venting of vapors to the atmosphere and prevents liquid fuel discharge. A vent tube coupling permits venting of those vapors to a standard marine atmospheric vent.

13 Claims, 3 Drawing Sheets

FUEL OVERFLOW PREVENTION SYSTEM WITH FEEDBACK

CROSS REFERENCE TO RELATED APPLICATION

This application is a continuation-in-part of U.S. application Ser. No. 08/715,007, filed Sep. 17, 1996, entitled Fuel Overflow Prevention System and assigned to a common assignee, now U.S. Pat. No 5,829,491.

BACKGROUND OF THE INVENTION

1. Field of Invention

The present invention relates to the field of fuel tank re-fueling devices. More particularly, the present invention relates to a device for prevention of fuel over-filling during re-fueling of a fuel tank. More particular yet, the present invention involves a fuel overflow prevention system particularly useful in a marine environment, where the system includes an optional audible signal to indicate fuel flow and level, and sealing features that account for expansion of fuel within the tank and to prevent fuel spillage.

2. Description of Prior Art

For as long as there have been fuel tanks and devices to refill them, there has been fuel spillage. Some contemporary estimates of fuel spillage are in excess of six million gallons annually in the United States alone. Globally, fuel spillage is many times this amount. The resultant fuel losses are economically and environmentally detrimental in terms of the wasted fuel resources and environmental contamination. Accordingly, numerous devices have been developed to prevent or otherwise limit fuel spillage during refueling. Known fuel containers that utilize such devices commonly include an intake, a fuel tank, and a vent. Typically, these devices are located in or around the intake and/or the vent.

In the field of fuel overflow prevention devices, there have been attempts to provide warning signals that indicate overflow conditions. It is to be noted at the outset, however, that these devices fail to account for expansion of the fuel within the tank. Nevertheless, while many fuel tanks have little in the way of a means for signaling that a tank is deemed to be effectively full, devices have been developed for that purpose. In general, there are two categories of such signaling devices. One category includes devices which are activated upon the fuel tank being filled reaching its defined full capacity, such devices typically being in the form of an audible alarm. The other category includes devices that disengage, or otherwise negate some constant signal, when the tank reaches a defined full fuel capacity. Such "negative" notification typically is in the form of an audible signal that is present during fueling but ceases when the tank is at or near full capacity.

The first category of overflow signaling devices having a signal activated only when the tank is full typically involves complexity are so complex that whatever advantages might otherwise be offered are undercut. Indeed, elaborate electronic sensing and signals have been developed with increased expense and complexity. Sensors in such devices are exposed to a variety of temperatures and petroleum distillates that may degrade the reliability of sensor components. The most serious aspect of this reliability problem in such prior-art devices is that sensor failure will not become apparent in the re-fueling process until after the tank has been overfilled and spillage has occurred. "Negative" activation alleviates much of this problem.

The second category of signaling devices utilizes "negative" activation by providing a constant signal during the fueling process that stops only when the tank is full. Although anyone using such a signaling device would readily notice if the device fails to produce the constant signal, other problems arise with such a device. Most commonly, a user will leave a fuel pump unattended during the re-fueling process. If the signal is an audible one, as it typically is, the user may be lulled into a false sense of control over the pump. When such a signal ceases, indicating that the tank is full, the user may then be unable to quickly access the pump so as to manually prevent overflow. Further, prior-art devices fail to substantially allow for thermal expansion of the fuel that can result in a full tank becoming "over-full" as the temperature rises. This can create a siphoning effect and a continuous fuel spill through the tank vent. One needs, therefore, to avoid filling the tank all the way.

Other related prior-art fuel overflow indicators have their own disadvantages. One prior-art re-fueling device is that of Delisle, Jr. et al. (U.S. Pat. No. 5,023,608) which involves a fuel filler alarm including a whistle and overflow reservoir combination that is attached to the vent hole of a fuel tank on a boat. The whistle in the Delisle device is designed to maintain an audible sound while fuel is being pumped into the fuel tank. When the fuel tank reaches its capacity, the whistle stops and, ideally, a fuel attendant will shut off the fuel pump. The device of Delisle does allow for some error by the fuel attendant such that excess fuel may be stored in the overflow reservoir; however, this is only a stop-gap measure that likely works only in situations where a relatively small amount of spilled fuel is involved. If a distracted fuel attendant were drawn away from the fuel pump for some extended period of time, fuel would certainly spill from an overfilled overflow reservoir. In addition, such a design is intended to allow the tank to be completely filled. Accordingly, Delisle fails to provide any gap in the tank for fuel expansion subsequent to being filled.

Other such prior-art re-fueling devices exist that are deficient for similar reasons. A general defect in the prior-art is that there are no re-fueling systems that allow for thermal expansion subsequent to re-fueling while providing adequate signaling of proper fueling. It is well known to those skilled in the art of fuel production that fuel can expand by several percent over a temperature range of between about 60 and about 212 degrees Fahrenheit—a range typically experienced by gasoline transferred from an underground storage tank to a boat's fuel tank during a hot summer day. Further, facilitation of the standard automatic-shutoff features of most fuel pumps by pressure-creating devices is absent in the prior-art. This type of fuel pump is widely used throughout the retail gasoline market and operates generally by mechanically sensing the change in pressure in a fuel pump's nozzle to automatically stop fuel flow when the fuel reaches the nozzle. Two representative prior-art devices are those of Schupp (U.S. Pat. No. 5,181,022) and Langlois (U.S. Pat. No. 5,515,891).

Schupp includes a reservoir housing similar to Delisle but one having electronic sensors that signal an overfilled condition, rather than a constant signal that ceases upon a full-tank condition. This design of Schupp fails to provide for electronic failure caused by exposure of electronics sensitive to corrosive fuels and/or fuel additives. As well, the Schupp device may be susceptible to false sensing caused by fumes or small amounts of fuel splashed around the sensor that erroneously indicates the fuel has reached the capacity of the tank. Such problems may result in excessive overflow or even a boater's reliance on an erroneous indication that the tank is full. Similarly, Langlois includes primary and secondary fuel tanks and a full condition alarm that act in a fashion much like Schupp and Delisle. Langlois exhibits several flaws, including, most importantly, a lack of any sealing features that would create pressure sufficient to activate automatic-shut-off fuel pumps.

It is to be noted that there are feedback system available in fuel pumping systems, such as the Perko™ fill and vent unit for a fuel inlet with feedback tube. This arrangement has some advantages in regard to formation of an automatic shutoff fuel nozzle; however, the fuel return tube does not prevent unintended overflow that may be caused by expansion of the fuel within the tank. It would therefore be advantageous to have a fuel overflow prevention system that may be coupled to a fuel return line used in conjunction with an automatic shutoff device.

Accordingly, the prior art fails to provide any fuel overflow prevention device that provides "negative" notification with reliable control of fuel flow. Therefore, what is needed is a fuel overflow prevention device that provides signaling during re-fueling that ceases when the tank is just below its capacity, thereby indicating that fuel pumping should be turned off. What is also needed is such a device that provides automatic shut-off features for instances when fuel pumping is not manually turned off. Further, what is needed is such a device that ensures activation of standardized pressure-sensitive-pump-shut-off-triggers by providing a substantially sealed arrangement. Still further, what is needed is such a device that prevents fuel spillage that occurs due to thermal expansion of fuel. Yet further, what is needed is such a device that is relatively simple and not reliant upon electronics that may cause complete system failure with the failure of a relatively minor component.

SUMMARY OF THE INVENTION

It is an object of the present invention to provide a fuel overflow prevention device that ceases the re-fueling process at the point when the fuel level is just below the capacity of the fuel tank so as to allow for thermal expansion of the fuel within the tank. Another object of the present invention is to provide a device that automatically arrests fuel pumping during situations when a fueling attendant is preoccupied or when fuel pumping is otherwise not manually turned off. Yet another object of the present invention is to provide a fuel overflow prevention device with a substantially sealed arrangement that ensures activation of standardized pump-shut-off-triggers of the pressure-sensitive type. Still another object of the present invention is to substantially prevent any fuel siphoning effect out of the vent of the fuel tank. Additionally, another object of the present invention is to provide an optional signal—typically an audible whistle—during the re-fueling process to provide positive assurance to a fuel attendant that refueling is occurring properly. Another object of the present invention is to provide such a device that is principally mechanical in nature, and that may use, but does not require the use of, sensitive electronic components.

The device of the present invention primarily includes two separate parts that operate in conjunction with one another. Although this discussion focuses on use of the present invention in a marine environment, any similarly fragile environment may benefit from the inventive concepts disclosed herein. Also, for purposes of illustration, the present invention is discussed in terms of use within a fuel tank of a marine vessel; however, it should be understood that the fuel overflow prevention device is not intended to be limited to marine vessel fuel tanks. The invention may be utilized in a variety of ways including, but not limited to, buried or in-basement home heating oil tanks and fuel tanks of gasoline or diesel-engine land vehicles.

A fuel overflow prevention device according to the present invention is a two-part device that includes a fuel-fill nozzle adapter used in conjunction with a fuel discharge preventor. The adapter is substantially conical in shape with a truncated end and a hole through its center. The outer diameter is shaped to fit into a tank opening for an airtight fit; the inner diameter is shaped to accept the nozzle. This shape and its compressibility allow it to be inserted over a standard fuel-fill nozzle. The adapter easily fits over most nozzles because it is preferably fabricated of a neoprene rubber. While a specific shape and material is disclosed here, it should be understood that any similar shape or material may be used so long as the adapter is of a sufficient hardness and dimensions to provide a tapered, self-sealing sleeve and made from a fuel resistant material (i.e., neoprene rubber). The primary purpose of the adapter is to provide any standard fuel-fill nozzle with a sealed interference fit in substantially any diesel or gasoline tank intake, regardless of the size of the intake.

The second part of the present invention is the discharge preventor, which is placed in the vent of the fuel tank to be protected. The discharge preventor has a housing threadingly matable—or otherwise connectable by any suitable means such as welding, riveting, or interference-fit—to the vent. The vent is typically located on some portion of the top surface of the fuel tank and the discharge preventor is arranged substantially perpendicular to the top surface of the tank. The preventor may be positioned immediately adjacent to the top surface of the tank. Alternatively, under those conditions in which there is little space immediately above the tank, an extension tube of selectable length may be used to link the vent to the protector. The discharge preventor includes a signal tube located within the housing. The signal tube has one open end located within the tank and exposed to the fuel. The other end of the signal tube includes a signal tube mouth located within the housing but external to the tank. Aligned with the signal tube is a ball-cock valve. The ball-cock valve is located within the housing and between an exit port of the housing and the signal tube mouth and may rest on a ball-holding element such as a pin or spring.

The discharge preventor may further include a barbed elbow that facilitates connection of the housing exit port to a vent hose. Although an L-shaped connector with a barb is disclosed, any suitable connector that provides adequate venting ability should be considered within the intended scope of the present invention. Alternatively, the exit port of the preventor may be coupled to a standard atmospheric vent by way of any suitable sort of water-trap tubing. Further, the signal tube mouth includes an audible-signaling means that is preferably a reed element that creates an audible whistle during tank re-fueling due to venting gases being displaced by fuel. This whistling provides the fuel attendant with audible verification that the tank is filling and not yet full.

It is to be noted that the nozzle adapter and the discharge preventor may be uncoupled. Alternatively, when an automatic fuel cutoff device is used, the discharge preventor may include a fuel return coupling, such as a fuel hose that permits transfer of any overflow fuel from within the signal tube to pass to the interior of the fuel inlet. Preferably, the fuel return coupling has an outlet that is directed to the interior of the fuel inlet proximate to the area where the end of an automatic shutoff nozzle would be positioned during the filling process. The fuel return coupling may also include one or more valves so as to enable isolation of the fuel inlet from the discharge preventor unit.

In operation, the fuel overflow prevention device allows for safe re-fueling of both gasoline-powered and diesel-powered marine vessels. The tapered nozzle adapter securely fits the mouth of the fuel fill inlet. When used with a standard automatic shut-off fuel nozzle, the invention will shut itself off automatically upon fuel reaching a level determined by the installed height of the discharge preventor. A signal will sound while fuel is going into the tank and when the signal stops, fueling is complete. Even if the fuel attendant is neither alerted to the signal stopping nor tending the pump, the ball-cock valve within the discharge preventor will close and thus allows the pressure within the tank to increase so that the standard shut-off fuel nozzle is activated.

It is to be understood that other objects and advantages of the present invention will be made apparent by the following description of the drawings according to the present invention. While a preferred embodiment is disclosed, this is not intended to be limiting. Rather, the principles set forth herein are illustrative of the scope of the present invention and it is to be further understood that numerous changes may be made without straying from the scope of the invention.

DETAILED DESCRIPTION OF THE PREFERRED EMBODIMENTS

Figure 1:
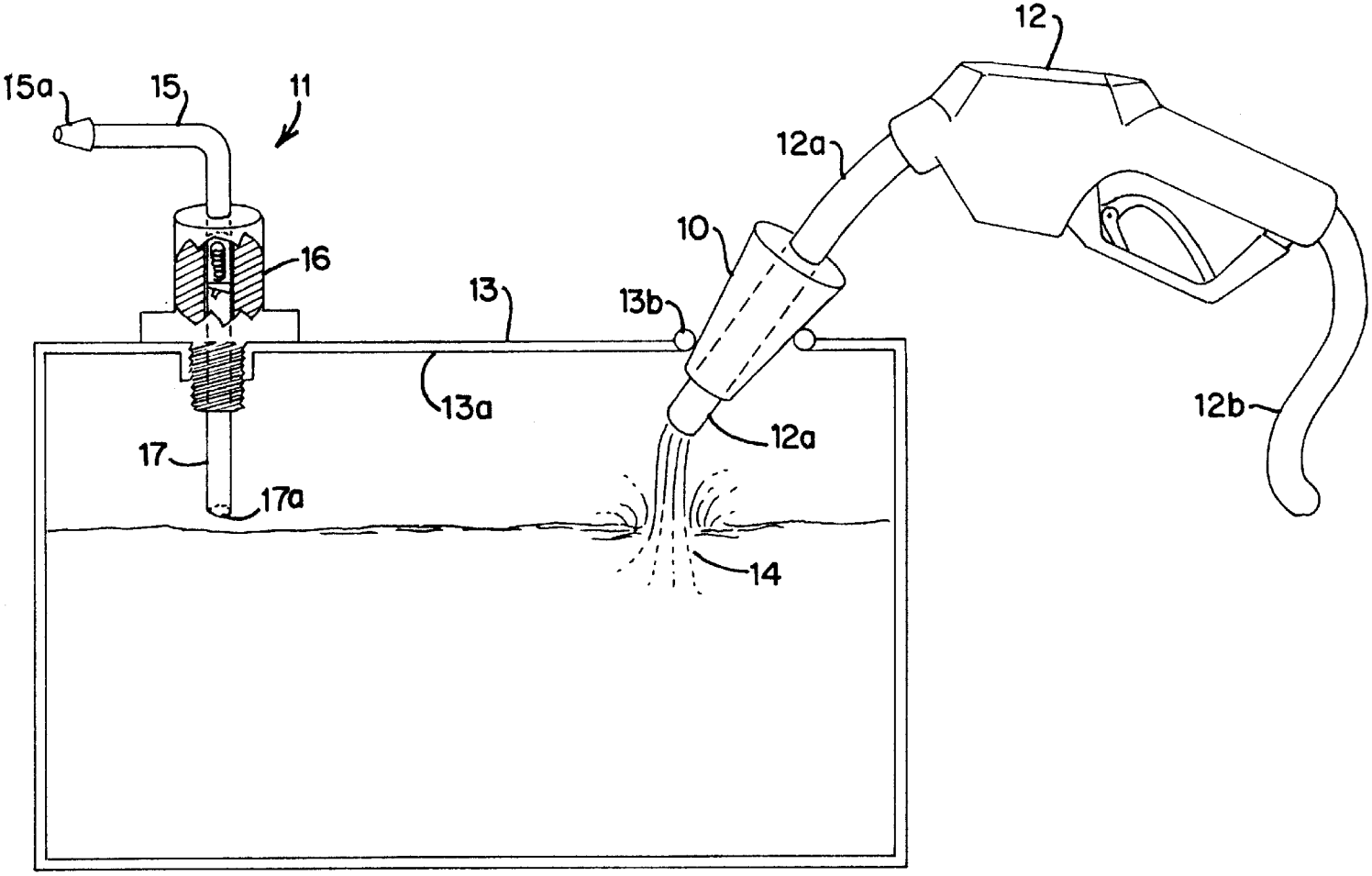
FIG. 1 is a perspective view of a fuel overflow prevention system in accordance with the preferred embodiment of the present invention showing a fuel tank being re-fueled.
Figure 2:
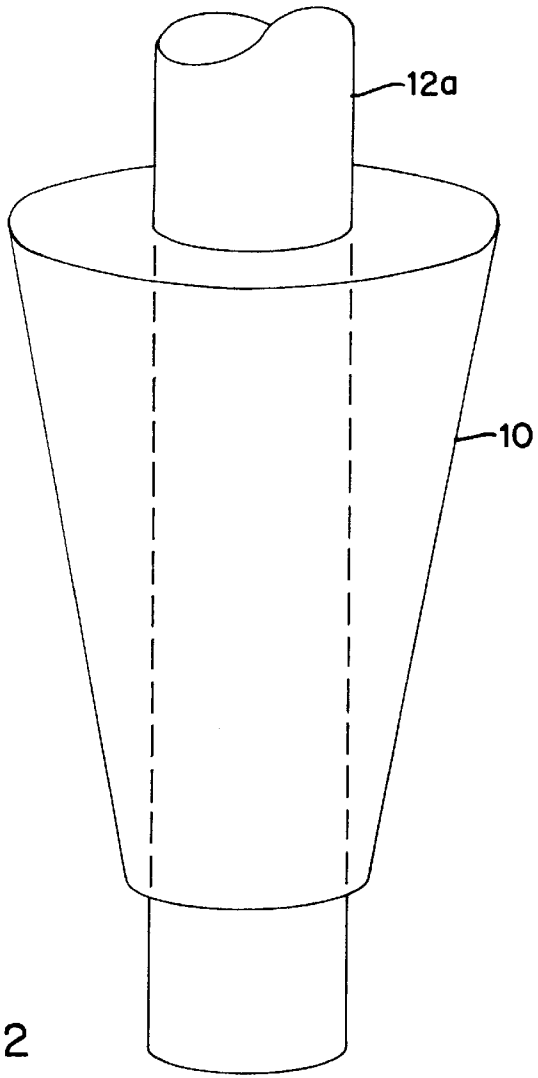
FIG. 2 is a close-up view of a nozzle adapter according to the present invention on a standard fuel nozzle of the type shown in FIG. 1.

In FIG. 1, a fuel overflow preventor 11 and a nozzle adapter 10 are shown according to the preferred embodiment of the present invention. The overflow preventor 11 and adapter 10 are shown with a common fuel tank 13 that is being filled with fuel 14. The adapter 10 is designed to fit over a standard nozzle 12*a* of a common automatic-shut-off fuel pump handle 12. Fuel 14 is pumped through a hose 12*b* by a standard fuel pump (not shown) in a manner is well known throughout the art. The adapter 10 is preferably conical in shape in order to provide a-positive-interference fit with an opening 13*b* of the fuel tank 13. As shown further in FIG. 2, this preferred shape is substantially that of a truncated cone with an axial hole therethrough. This shape ensures that the adapter 10 fits over substantially all sizes of the nozzle 12*a* and into all sizes of opening 13*b*. Preferably, the adapter 10 is fabricated from a medium-hardness, neoprene rubber; however, any material that provides sufficient sealing between the nozzle 12*a* and inside of the opening 13*b* of the tank 13, and is substantially fuel resistant, may be suitable. Such sealing prevents leakage of tank gases or fuel through the opening 13*b*.

Figure 3:
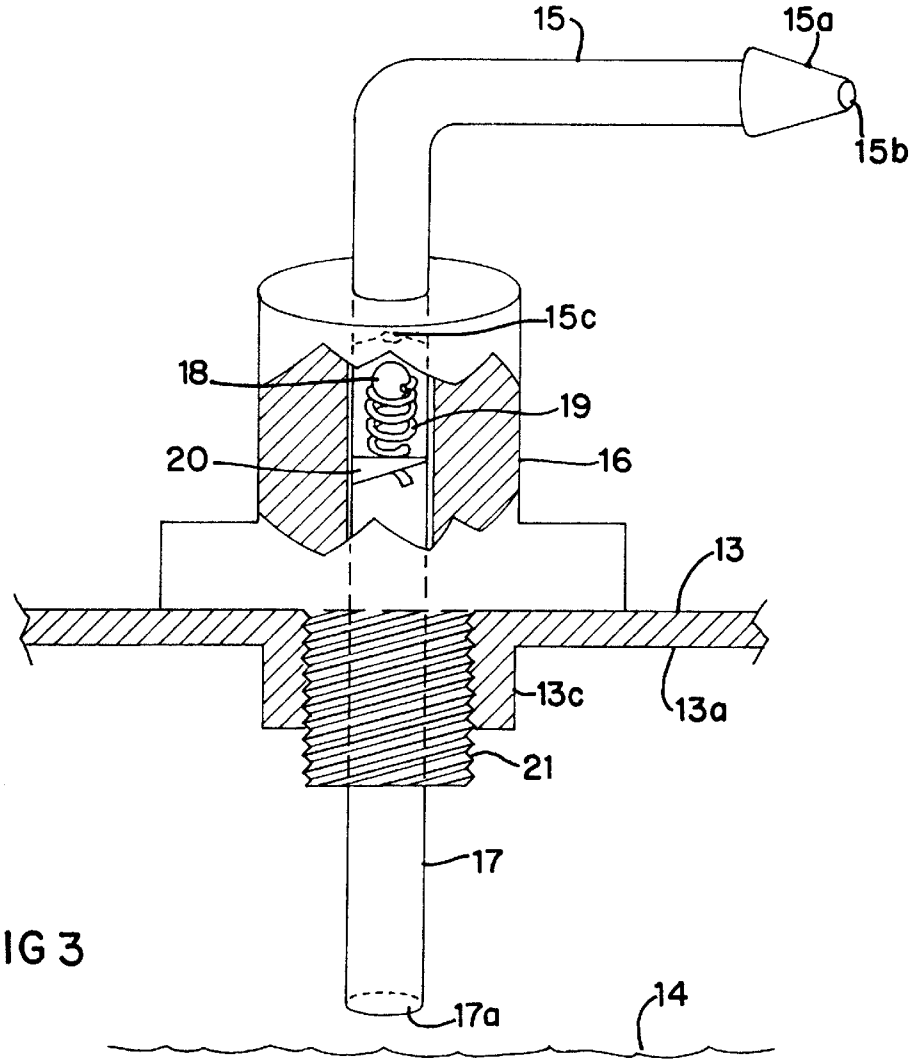
FIG. 3 is partial cut-away view of a fuel discharge preventor according to the present invention mounted on a standard fuel tank of the type shown in FIG. 1.

In FIG. 1 and FIG. 3, the fuel overflow preventor 11 is shown mounted to the fuel tank 13. The fuel overflow preventor 11 includes a housing 16. The housing 16 includes a threaded section 21 by which the fuel overflow preventor 11 is attached to the fuel tank 13. For purposes of definiteness, the fuel overflow preventor 11 is illustrated here as threadingly attached to a threaded fuel tank hole 13*c*; however, any suitable manner of connection may be used to mount the fuel overflow preventor 11 to the fuel tank 13.

Additional reference to FIG. 3 discloses that the housing 16 includes a vent tube 15 and a signal tube 17 serially arranged therethrough. Between the vent tube 15 and the signal tube 17 is a fuel-blocking component that is preferably a ball 18. A ball-holding component, such as a spring 19 shown in FIG. 3, or a fixed cross pin (not shown) is located within the signal tube 17. The ball-holding component is designed to be lightly loaded and is further designed to hold the ball 18 within the signal tube 17 just above a signal element 20. A pin may be used instead of the spring 19 so as to reduce any detrimental effect that may be caused by complete or partial failure of the spring 19. The vent tube 15 has a ball-seat 15*c* located at one end and an exit vent 15*b* located at the other end. The exit vent 15*b* includes a barb 15*a* upon which a vent hose (not shown) may be mounted in order to vent fuel tank gases away from the area of the fuel tank 13, possibly for recovery. The signal tube 17 includes the signal element 20 and an intake 17*a* located at opposite ends thereof. While the signal element 20 is shown as a slotted whistle, any suitable design may suffice such as a reed element. The signal element 20 provides an audible whistling sound as gases within the fuel tank 13 are forced from the intake 17*a* to the exit vent 15*b* via the signal element 20 as fuel 14 fills the tank 13.

In operation, the adapter 10 and fuel overflow preventor 11 act together as a fuel overflow prevention system. During re-fueling, fuel 14 will be pumped into the tank 13 through the nozzle 12*a* of the standard automatic-shut-off pump handle 12. The nozzle 12*a* fitted with adapter 10 will ensure that substantially all gases displaced by the fuel 14 exits through the fuel overflow preventor 11. As these gases pass through the fuel overflow preventor 11 via signal tube 17 and vent tube 15, an audible whistling sound is created by the signal element 20. This sound alerts the person attending to the re-fueling that the re-fueling process is progressing as it should. As the amount of the fuel 14 increases in the tank 13, the empty space in the tank 13 reaches a predetermined level. This predetermined level is a fuel expansion allowance.

The fuel expansion allowance is set by the distance between the plane including a top surface 13*a* of the fuel tank 13 and the plane including the intake 17*a*. This distance is dictated by the thermal coefficient of expansion of the specific fuel used and the tank shape. The more the fuel used is predicted to expand the greater the distance needed. When the rising fuel 14 reaches the intake 17*a*, intake 17*a* is sealed off from the gas space and displaced gases cease to flow through the signal element 20. This results in a cessation of the whistle sound that alerts the fuel attendant that the fuel tank 13 is full. Regardless of whether the fuel attendant is inattentive or, alternatively, engages the automatic-shut-off pump handle 12 and leaves the pump unattended, the instant overflow prevention system will ensure that pressure increases within the tank 13 sufficient to activate the automatic-shut-off feature of handle 12. The pressure increase is facilitated by ball 18 that seats itself on the ball-seat 15*c* when the fuel expansion allowance is attained. Thus, gases are exhausted through ball-seat 15*c* until the ball 18 is seated. This seating results in a total cessation of the audible whistling sound.

Figure 4:
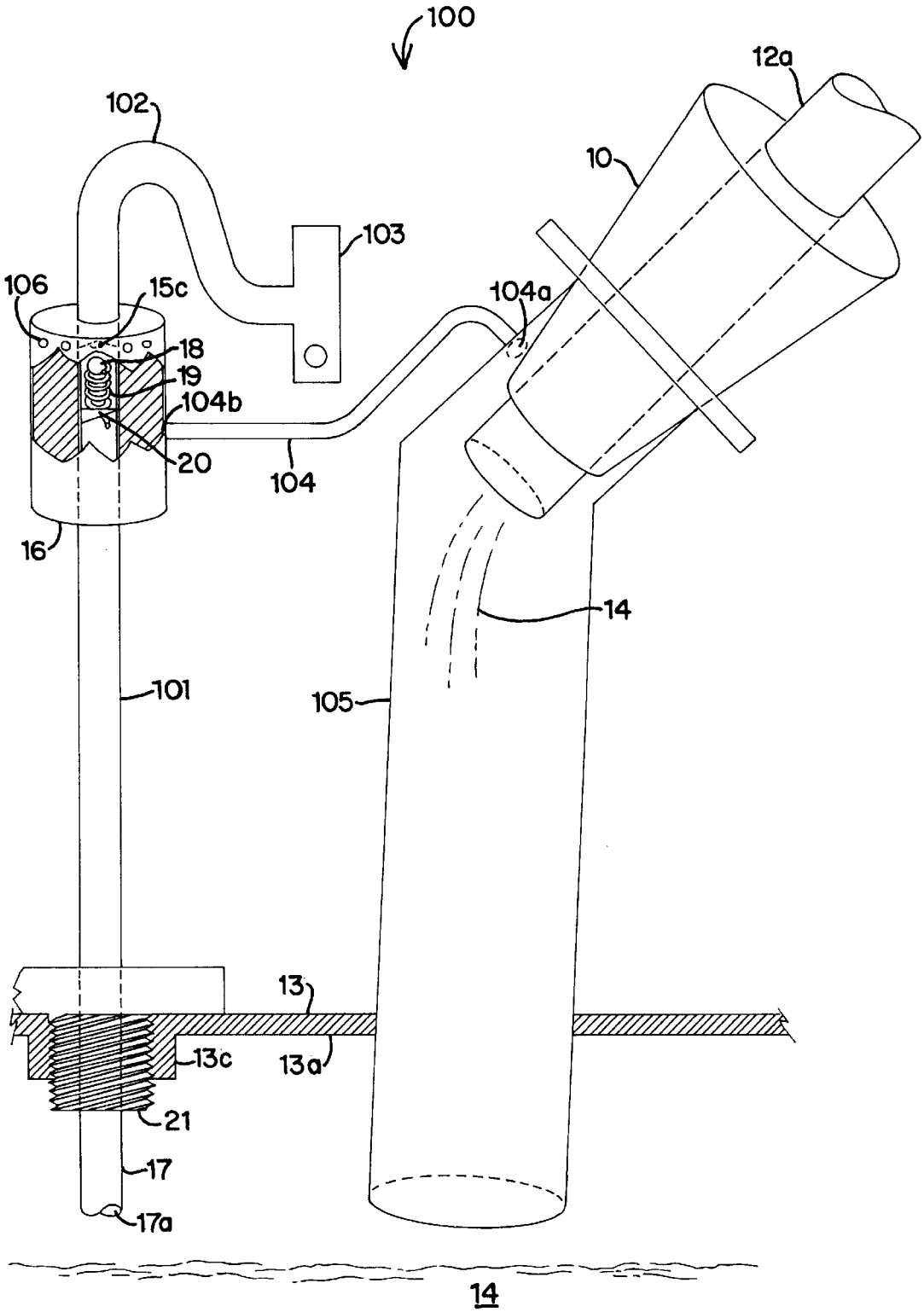
FIG. 4 is a simplified side view of an alternative embodiment of the present invention, showing a fuel discharge preventor of the present invention having an extension tube and a fuel return coupling for excess fuel feedback to an automatic shutoff nozzle.

An alternative discharge unit 100 is shown in FIG. 4 in which like components described previously are assigned like element numbers. The alternative unit 100 includes the housing 16 including the same components previously described with respect to FIG. 3. However, the unit 100 has been modified to include a signal tube extension 101 forming an extension of tube 17 so that the housing 16 may be placed outside of any bulkhead that may otherwise be positioned too close to the top of the tank 13 to allow its mounting thereon. Extension 101 simply provides the pathway for additional vapor and/or excess fluid from within the tank 13 to contact the discharge protector components under those physical location limitations.

With continuing reference to FIG. 4, unit 100 includes transfer coupling 102 to allow venting of vapors from the housing 16. The coupling 102 may be any suitable sort of hosing that is preferably resistant to decay caused by contact with fuel vapors. The coupling 102 may simply vent to atmosphere or, alternatively, it may be connected to a common marine atmospheric vent 103. The alternative unit 100 may also include a fuel return tube 104 to be used in conjunction with an automatic fuel shutoff nozzle. Any excess fuel 14 rising in extension 101 will be shunted over to a fuel inlet tube 105 by way of the return tube 104 at a return tube outlet 104*a*. A return tube inlet 104*b* is coupled to an interior of the housing 16 at a selectable point below the position of the blocking ball 18. This design ensures that any excess fuel within the tank 13 will be shunted away from tube 102. As with the other couplings, tube 104 may be any sort of Coast Guard approved gas hose. The coupling 102 and the tube 104 may optionally be valved as desired. Finally, the alternative unit 100 may include one or more venting ports 106 of the housing 16 so as to provide suitable atmospheric pressure for fuel transfer out of the housing 16.

It should be understood that the preferred embodiment mentioned here is illustrative of one variation the present invention and that numerous design modifications and variations in use of the present invention may be contemplated in view of the following claims without straying from the intended scope and field of the invention herein disclosed.

I claim:

1. A fluid overflow prevention device for use with a liquid fuel tank having a first tank opening and a second tank opening, wherein said first opening and said second opening are located at a top surface of said fuel tank, wherein said first tank opening is a fuel inlet and said second tank opening is a vent to atmosphere, said device comprising:

a) a nozzle adapter for securing a nozzle of a pressure-sensitive pump handle to said first tank opening during flow of a fluid into said tank through said nozzle;

b) a signal tube and a vent tube in combination and adaptable to be attached to said second tank opening, wherein said signal tube includes an intake opening for receiving fuel gases from within said fuel tank, wherein said signal tube includes a signal element located at an end opposite to where said intake opening is located, and wherein said vent tube is attached to said signal tube opposite end and includes an exit vent and a combination of a fuel-blocking component and a ball seat, wherein said combination of said fuel-blocking component and said ball seat is designed to permit said fuel gases entering said intake opening to exit said exit vent and to prevent any liquid fuel entering said intake opening from exiting said exit vent;

c) a housing for joining said signal tube and said vent tube together, wherein said housing includes an interior section;

d) a mounting section to secure said housing to said second tank opening; and e) a return tube having a first end coupled to said interior of said housing and a second end coupled to said fuel inlet.

2. The device as claimed in claim 1 further comprising a vent tube coupling connected to said vent tube, wherein said vent tube coupling is further connected to a standard marine atmospheric vent.

3. The device as claimed in claim 2 wherein said signal tube includes an extension tube positioned between said housing and said mounting section.

4. The device as claimed in claim 1 wherein said signal tube includes an extension tube positioned between said housing and said mounting section.

5. The device as claimed in claim 1 wherein said nozzle is an automatic-shut-off fuel pump nozzle, and said fuel is introducible into said tank only up to a predetermined level that allows a fuel expansion space to remain in said tank after filling.

6. The device as claimed in claim 5 wherein said predetermined level is determined by a distance between a plane including an inner top surface of said fuel tank and a plane including said intake opening.

7. The device as claimed in claim 1 wherein said signal tube includes an extension tube positioned between said housing and said mounting section.

8. A fluid overflow prevention device for use with a liquid fuel tank having a first tank opening and a second tank opening, wherein the first opening and the second opening are located at a top surface of the fuel tank, wherein the first tank opening is a fuel inlet and the second tank opening is the only means by which fuel may be vented to the atmosphere, said device comprising:

a) a nozzle adapter for securing a nozzle of a pressure-sensitive pump handle to the first tank opening during fluid flow into the tank through the nozzle;

b) a signal tube and a vent tube in combination and adaptable to be attached to the second tank opening, wherein said signal tube includes a first end with an intake opening for receiving fuel gases from within the fuel tank and an opposite end, and wherein said vent tube is attached to said signal tube opposite end and includes an exit vent and a combination of a fuel-blocking component and a ball seat, wherein said combination of said fuel-blocking component and said ball seat is designed to permit said fuel gases entering said intake opening to exit said the fuel tank and to prevent any liquid fuel from exiting the fuel tank;

c) a housing for joining said signal tube and said vent tube together;

d) a return tube having a first end coupled to an interior of said housing and a second end coupled to said fuel inlet; and e) a mounting section to secure said housing to said second tank opening.

9. The device as claimed in claim 8 wherein said signal tube further includes a signal element located at an end opposite to where said intake opening is located.

10. The device as claimed in claim 9 wherein said nozzle is an automatic-shut-off fuel pump nozzle, and said fuel is introducible into said tank only up to a predetermined level that allows a fuel expansion space to remain in said tank after filling.

11. The device as claimed in claim 10 wherein said predetermined level is determined by a distance between a plane including an inner top surface of said fuel tank and a plane including said intake opening.

12. The device as claimed in claim 8 further comprising a vent tube coupling connected to said vent tube, wherein said vent tube coupling is further connected to a standard marine atmospheric vent.

13. The device as claimed in claim 8 wherein said signal tube includes an extension tube positioned between said housing and said mounting section.

* * * * *